US005406810A

United States Patent [19]

Chen

[11] Patent Number: 5,406,810

[45] Date of Patent: Apr. 18, 1995

[54] JOINT LOCK WITH IMPROVED STRUCTURE

[76] Inventor: Fu-Li Chen, No. 1, Lane 28, Li-Hsing St., Yung-Kang City, Tainan Shien, Taiwan, Prov. of China

[21] Appl. No.: 145,102

[22] Filed: Nov. 3, 1993

[51] Int. Cl.[6] ..... E05B 67/06

[52] U.S. Cl. ..... 70/18; 70/30; 70/49; 70/53; 70/417

[58] Field of Search ..... 70/15, 18, 30, 49, 53, 70/58, 259, 260, 233, 417

[56] References Cited

U.S. PATENT DOCUMENTS

| | | | |
|---|---|---|---|
| 1,380,719 | 6/1921 | Johnson | 70/53 |
| 1,384,561 | 7/1921 | Hampton | 70/49 |
| 1,520,902 | 12/1924 | Junkunc | 70/49 |
| 1,539,301 | 5/1925 | Cooper | 70/53 |
| 1,566,965 | 12/1925 | Johnson | 70/49 |
| 1,786,511 | 12/1930 | Warren | 70/49 |

FOREIGN PATENT DOCUMENTS

| | | | |
|---|---|---|---|
| 470145 | 3/1952 | Italy | 70/30 |
| 178900 | 4/1922 | United Kingdom | 70/49 |
| 2240578 | 8/1991 | United Kingdom | 70/49 |

*Primary Examiner*—Lloyd A. Gall

[57] ABSTRACT

A joint lock with improved structure is disclosed. The joint lock includes a steel rope wire, a latching member for latching the steel rope wire in position, a bendable covering sleeve for covering the steel rope wire, and a lock device. The lock device is composed of a locking member and a locking plug, in which the locking member is fixed on one end of the rope wire and the locking plug is fixed on the other end of the rope wire. The latching member is composed of a plurality of fork chucks and a latching ring having its inner diameter slightly larger than the outer diameter of the steel rope wire and being slidable along the rope wire. The fork chucks is a flexible outward fork-like structure in order to engage with the inner wall of the covering sleeve. The covering sleeve is composed of a plurality of joint units for covering the rope wire so that the rope wire is bendable correspondingly when the covering sleeve is bent. Each joint unit has a convex surface and a concave surface, and one end of the joint unit has an outward flange while the other end of the joint unit has an inward flange for associating with the outward flange of another joint unit when two adjacent joint units are connected.

1 Claim, 6 Drawing Sheets

JOINT LOCK WITH IMPROVED STRUCTURE

BACKGROUND OF THE INVENTION

The present invention relates to an improved joint lock, and more particularly to a joint lock with a bendable covering sleeve for covering and protecting the steel rope wire of the joint lock. The bendable covering sleeve is composed of a plurality of metal joint units forming a continuous bendable and flexible sleeve. The covering sleeve may replace the complex beading structure of the conventional sleeve, and has advantages of convenience in assembly and lower manufacture cost.

The well-known joint lock is illustrated in FIG. 1, showing the exploded view of the joint lock mechanism. The sectional view of the joint unit which consists of a beading string of the prior art of FIG. 1 is further illustrated in FIG. 2. The prior art joint lock includes a rope wire 10 with a suitable length. A locking member 11 is fixed on one end of the rope wire, and a locking plug 12 is fixed on the other end of the rope wire to form a lock device. In order to protect the rope wire 10 from being destroyed, the rope wire 10 is covered with a plurality of tubes 13 and beads 14 connected in series mechanically to form a protecting sleeve. The tubes and beads are provided with central through hole, so the rope wire 10 may be inserted into the tubes 13 and beads 14. The outer diameter of the bead is larger than the inner diameter of the tube so that the open ends of the tube 13 may engage with the adjacent beads when assembled to form a bendable beading string. In such an arrangement, the assembled beading string is not only capable of protecting the rope wire therein, but also forms a bendable sleeve.

Although the prior art beading string may protect the rope wire against destruction, it has various disadvantages as follows:

1. Higher cost: Because the beading string is composed of a plurality of tube elements and bead elements, it requires two dies to manufacture the elements, thereby causing a higher manufacturing cost.
2. Complex assembly procedure: The beading string must be assembled manually one by one. In assembly, one tube must be followed by a bead, and then the bead must be followed by another tube in sequence to assemble a string. In case of missing any one tube or bead element during assembly, it must be reassembled, which will waste much time and cause inconvenience.
3. Easy to be destroyed: Because the tube of the beading string engages with the outer surface of the bead, the tube and the bead is easy to be damaged during bending operation.

SUMMARY OF THE INVENTION

Consequently, the primary object of the present invention is to provide a joint lock with improved structure. The joint lock of the present invention has advantages of lower manufacture cost and convenience of assembly.

The other object of the present invention is to provide a bendable covering sleeve used to cover and protect the steel rope wire of the joint lock. The joint lock of the present invention is further provided with a latching member for latching the rope wire. The latching member is composed of a latching ring and a plurality of fork chucks. The inner diameter of the latching ring is slightly larger than the outer diameter of the steel rope wire and therefore is slidable along the steel rope wire. The fork chucks are extended from one side of the latching ring, forming a flexible outward fork-like structure for engaging with the inner wall of the covering sleeve.

In order that the present invention may more readily be understood, the following description is given, merely be way of example, reference being made to the accompanying drawings in which:

DESCRIPTION OF THE PREFERRED EMBODIMENT

Figure 1:
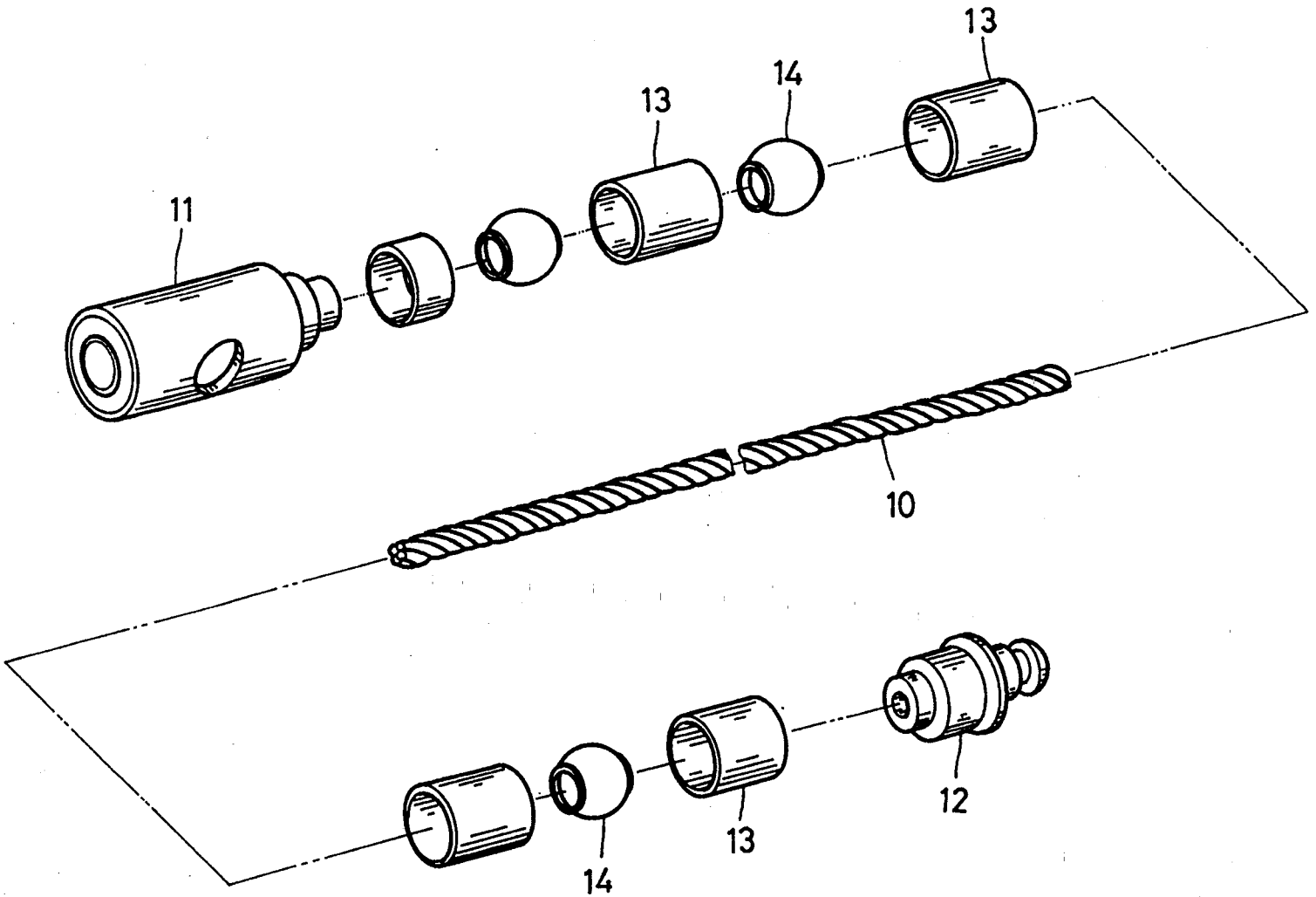
FIG. 1 (PRIOR ART)
FIG. 1 is an exploded view of a prior art joint lock mechanism.
Figure 2:
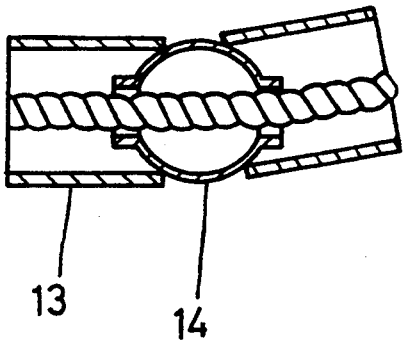
FIG. 2 (PRIOR ART)
FIG. 2 is a sectional view of a joint unit of the prior art joint lock shown in FIG. 1.
Figure 3:
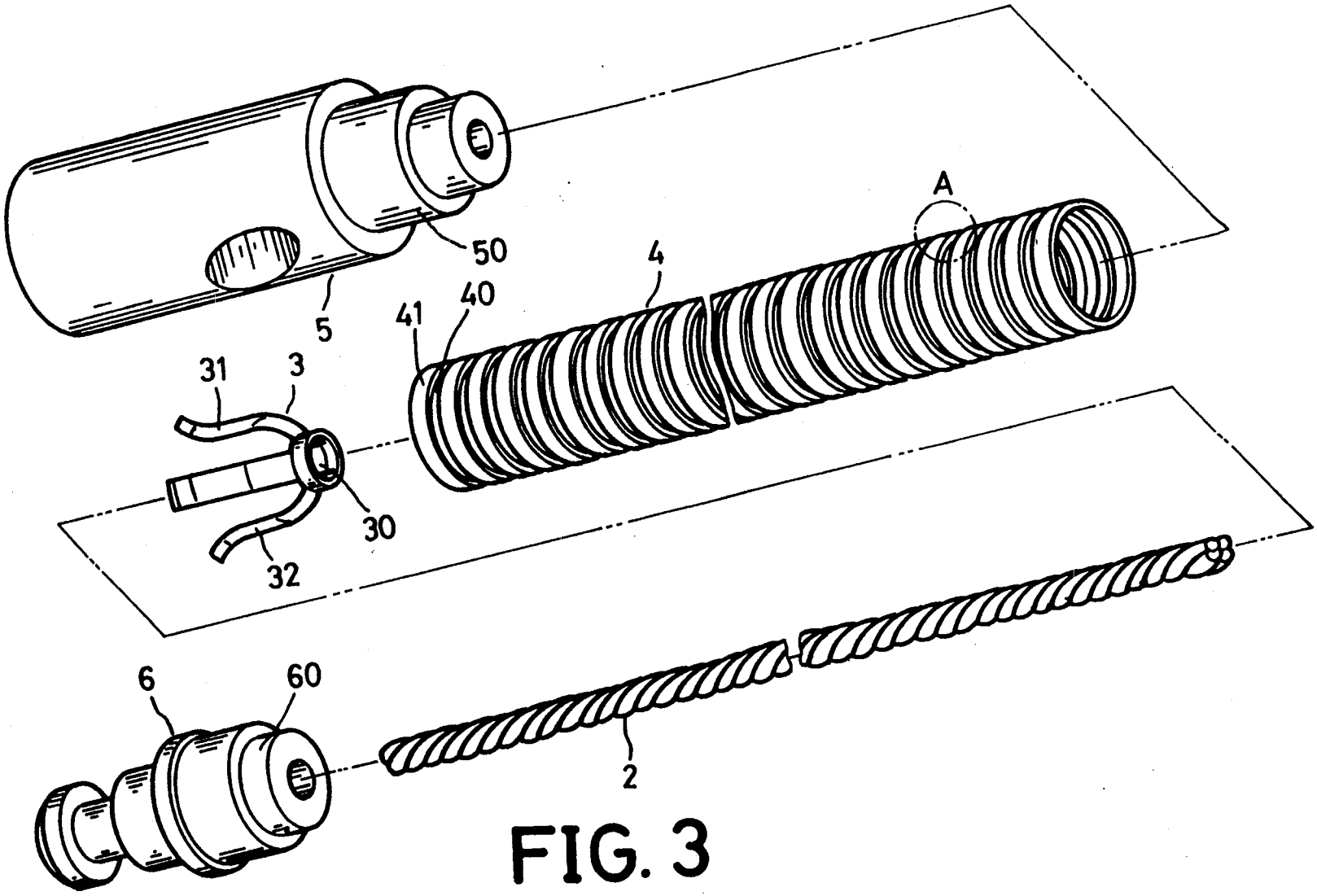
FIG. 3 is an exploded view of the joint lock in accordance with the present invention.

Referring now to FIG. 3, it shows an exploded view of the joint lock in accordance with the present invention. The joint lock is mainly composed of a steel rope wire 2, a latching member 3 for latching the steel rope wire 2 in position, a bendable covering sleeve 4 for covering and protecting the steel rope wire 2, a locking member 5 fixed on one end of the rope wire 2, and a locking plug 6 fixed on the other end of the rope wire 2. The latching member 3 is composed of a latching ring 30 and a plurality of fork chucks 31 and 32. The inner diameter of the latching ring 30 is slightly larger than the outer diameter of the steel rope wire 2 and therefore is slidable along the steel rope wire 2. The fork chucks 31 and 32 are extended from one side of the latching ring 30, forming a flexible outward fork-like structure.

Figure 4:
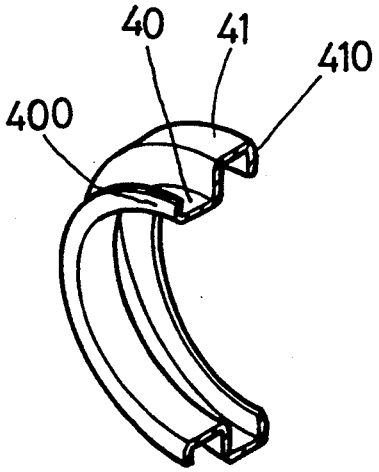
FIG. 4 is a partial sectional perspective view of the joint unit of the joint lock shown in FIG. 3.

The bendable covering sleeve 4 is made of metal material and may be freely flexible and bendable when in use. In order to make the sleeve bendable and flexible, the covering sleeve of the present invention is composed of plurality of joint units to form a pipe structure. As illustrated in FIG. 3, each joint unit of the covering sleeve 4 has a convex surface 41 and a concave surface 40, forming a continuous extended sleeve with convex and concave surface. The structure of the joint unit is further illustrated in FIG. 4, showing the portion sectional view thereof. Each joint unit has an outward flange 400 formed at the open end of the concave surface 40 of the joint unit, while an inward flange 410 is formed at the open end of the convex surface 41 of the joint unit. So, when two joint units are joined, the outward flange of the first joint unit may associate with the inward flange of the second joint unit.

The locking device of the present invention is composed of a locking member 5 and a locking plug 6. The one end of the locking member 5 is formed with a mounting cylinder 50 for mounting with the open end of the bendable covering sleeve 4. In addition, the locking member 5 is provided with a locking hole formed on the side wall thereof as illustrated in FIG. 3. The one end of the locking plug 6 is also provided with a mounting cylinder 60 for mounting with the other open end of the bendable covering sleeve 4, and the other end of the locking plug 6 is formed with a locking collar, as illustrated in the drawing, in order to be inserted into the locking hole of the locking member 5 described above.

Figure 5:
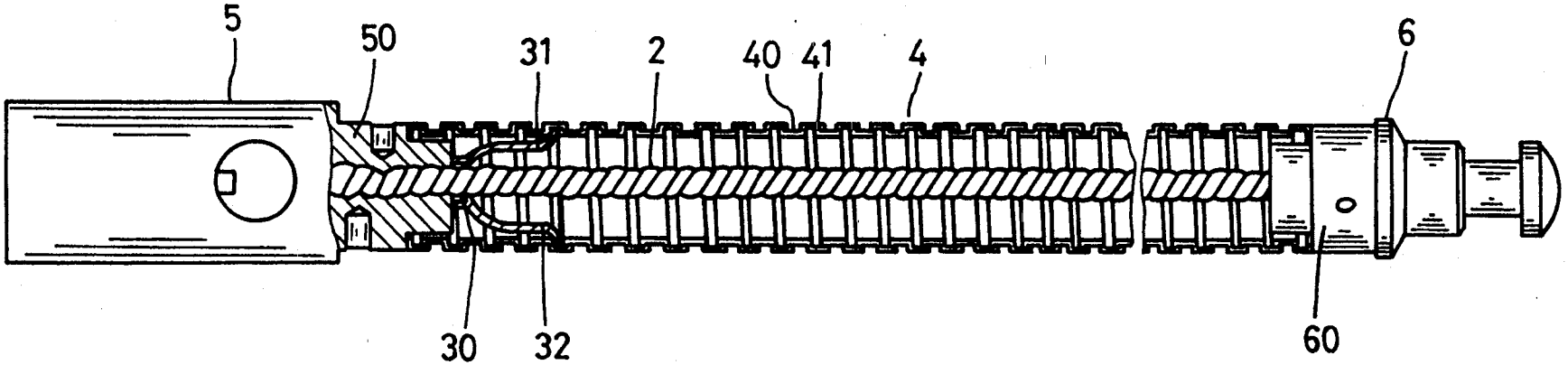
FIG. 5 is a sectional view of the joint lock of the present invention after assembly, showing that one end of a steel rope wire is connected with a locking plug and the other end thereof is connected with a locking member.

In assembly, with reference to FIG. 5, the steel rope wire 2 is first inserted into the latching ring 30 of the latching member 3, and then the bendable covering sleeve 4 is pulled over that assembly, in the direction from the latching ring 30 to the fork chucks 31 and 32, onto the steel rope wire 2. In the preferred embodiment of the present invention, the covering sleeve 4 may be slid along the rope wire only in one direction, because the fork chucks 31 and 32 are flexible and have an outward fork-like structure. Once the rope wire 2 is inserted into the covering sleeve 4, the end tip of each fork chuck 31 and 32 may limit the slide direction of the sleeve. Finally, the locking member 5 and the locking plug 6 may be tightly fixed on two ends of the steel rope wire 2 respectively, by using well-known compressing technique.

Figure 6:
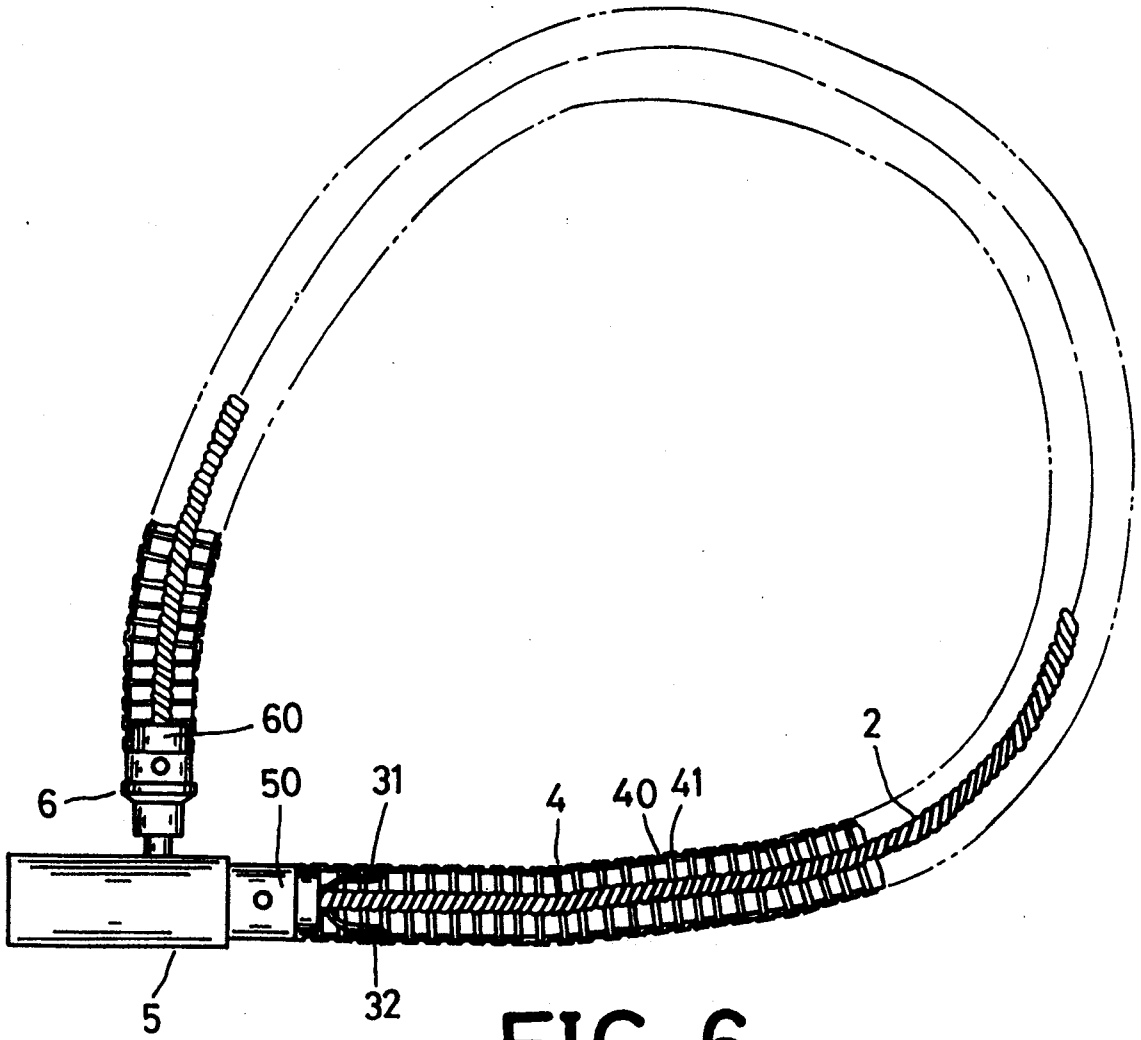
FIG. 6 illustrates one end of the locking plug is inserted into the locking member so as to form a locked situation of the joint lock of the present invention.

FIG. 6 illustrates the locking plug 6 is associated with the locking member 5 so as to form a locking situation of the lock of the present invention. In use, when the covering sleeve 4 is bent in any direction, the rope wire 2 in the covering sleeve 4 will be bent correspondingly. Because the covering sleeve 4 is a flexible and bendable metal sleeve having a structure of continuous convex surfaces and concave surfaces, the steel rope wire 2 may be further protected against strike. Moreover, the metal covering sleeve and the steel rope wire in combination form a more reliable locking device with a stronger structure. Moreover, since the locking device of the present invention is provided with a latching member 3, the rope wire 2 may be secured at a fixed position in the inner space of the covering sleeve 4 so as to prevent displacement and rotation.

From the description above, it is noted that the advantages of the preferred embodiment are as follows.

1. The manufacture cost of components may be lower.
2. It is faster and more convenient in assembly.
3. It is not easy to be destroyed when the lock is struck by outward force.

In conclusion, from the detail description above, it is obvious that the present invention has improvement in structure and is a novelty lock device in this field. Therefore, the present invention meets the requirements of novelty and practical use. While the arrangement and structure described above constitutes a preferred embodiment of this invention, it is to be understood that the present invention is not limited to this precise form and that changes may be made therein without departing from the scope and spirit of the invention as defined in the appended claim.

I claim:

1. A joint lock comprising a steel rope wire having a first end and a second end, a latching member for latching the steel rope wire, a bendable covering sleeve for covering and protecting the steel rope wire, a locking member fixed on the first end of the rope wire, and a locking plug fixed on the second end of the rope wire, wherein the latching member is composed of a plurality of fork chucks and a latching ring having its inner diameter slightly larger than the outer diameter of the steel rope wire and being slidable along the rope wire, the fork chucks being a flexible outward fork-like structure, the covering sleeve being formed by a plurality of joint units for covering the rope wire so that the rope wire is bendable correspondingly when the covering sleeve is bent, each joint unit having a convex surface and a concave surface, and one end of each joint unit having an outward flange while the other end of each joint unit having an inward flange for associating with the outward flange of another joint unit.

* * * * *